US008082697B2

(12) United States Patent
Griffiths

(10) Patent No.: US 8,082,697 B2
(45) Date of Patent: Dec. 27, 2011

(54) SUNSCREEN AND MOUNTING BRACKET ASSEMBLY

(75) Inventor: Robert T. Griffiths, Elk River, MN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 29 days.

(21) Appl. No.: 12/762,528

(22) Filed: Apr. 19, 2010

(65) Prior Publication Data

US 2010/0263298 A1 Oct. 21, 2010

Related U.S. Application Data

(60) Provisional application No. 61/171,385, filed on Apr. 21, 2009.

(51) Int. Cl.
*E04B 1/34* (2006.01)

(52) U.S. Cl. ..... 52/73; 248/273; 52/74; 52/201

(58) Field of Classification Search ..... 52/73–74, 52/201, 793.1, 794.1; 248/273; 135/117, 135/119; 120/3
See application file for complete search history.

(56) References Cited

U.S. PATENT DOCUMENTS

| | | | | |
|---|---|---|---|---|
| 2,589,647 | A * | 3/1952 | Van Gelder et al. | 49/82.1 |
| 4,903,455 | A * | 2/1990 | Veazey | 52/800.11 |
| 5,095,672 | A * | 3/1992 | Tanikawa | 52/215 |
| 5,148,640 | A * | 9/1992 | Reilly, Sr. | 52/74 |
| 5,209,031 | A * | 5/1993 | Tavano | 52/92.2 |
| 5,737,874 | A * | 4/1998 | Sipos et al. | 49/67 |
| 6,167,897 | B1 * | 1/2001 | Resso et al. | 135/121 |
| 6,505,669 | B2 * | 1/2003 | Lilie et al. | 160/371 |
| 7,000,362 | B1 * | 2/2006 | Cullinan | 52/780 |
| 7,836,641 | B2 * | 11/2010 | Back et al. | 52/90.1 |
| 7,861,990 | B2 * | 1/2011 | Barnes | 248/273 |
| 7,946,094 | B2 * | 5/2011 | Huang et al. | 52/846 |

* cited by examiner

*Primary Examiner* — Brian Glessner
*Assistant Examiner* — Gisele Ford
(74) *Attorney, Agent, or Firm* — Jason A. Houser; Fay Sharpe LLP

(57) ABSTRACT

A mounting bracket assembly is included that is capable of securing an associated rigid sunscreen on an associated building structure. The mounting bracket assembly can include a first bracket that is adapted for securement on the associated building structure and a second bracket that is adapted for securement on the associated rigid sunscreen. The first bracket can include a first interengaging feature, and the second bracket can include a second interengaging feature that is cooperative with the first interengaging feature of the first bracket. A sunscreen and mounting bracket assembly, a sunscreen and mounting bracket kit, and a method of assembly are also included.

23 Claims, 5 Drawing Sheets

SUNSCREEN AND MOUNTING BRACKET ASSEMBLY

This application claims priority from U.S. Provisional Patent Application No. 61/171,385 filed on Apr. 21, 2009, the entire disclosure of which is hereby incorporated by reference herein.

The subject matter of the present disclosure broadly relates to the art of building structures and, more particularly, to a sunscreen and mounting bracket assembly for a building structure. A mounting bracket assembly, a sunscreen and mounting bracket kit and method of installing a sunscreen using the mounting bracket assembly are also included.

BACKGROUND

Elongated and relatively rigid bodies are known to be installed along the exterior of building structures to block light and other forms of radiation from being transmitted into the interior of the building structure. Such known devices are often referred to as sunscreens and are primarily utilized to block direct sunlight and radiation from entering the interior of the building structure through the windows thereof. Accordingly, sunscreens are typically secured on the exterior of a building structure and extend horizontally along or across the windows thereof. In many cases, known sunscreens are positioned toward the top of (or even above) the windows that are being shaded.

Notwithstanding the overall usage and benefits of known exterior sunscreens, in some cases known constructions have been found to be difficult and/or time consuming to install. This can undesirably lead to increased costs associated with the installation and use of exterior sunscreens. Accordingly, it is believed desirable to develop a sunscreen and mounting bracket assembly that overcomes the foregoing and/or other disadvantages of known sunscreen constructions.

BRIEF DESCRIPTION

One example of a mounting bracket assembly in accordance with the subject matter of the present disclosure that is capable of securing an associated rigid sunscreen on an associated building structure can include a first bracket that is adapted for securement on the associated rigid sunscreen. The first bracket can include a first interengaging feature. A second bracket is also included that is adapted for securement on the associated building structure and includes a second interengaging feature that is cooperative with the first interengaging feature of the first bracket.

Another example of a mounting bracket assembly in accordance with the subject matter of the present disclosure that is dimensioned for securement along an associated rigid sunscreen and adapted to secure the associated rigid sunscreen to an associated building structure can include a first bracket and a second bracket. The first bracket can be dimensioned for securement along the associated rigid sunscreen. The second bracket is separate from the first bracket and is adapted for cooperative interengagement with the first bracket and for securement on the associated building structure. The first and second brackets can interengage one another such that first and second tabs of the first bracket are at least partially received in respective ones of first and second recesses of the second bracket.

One example of a sunscreen and mounting bracket assembly in accordance with the subject matter of the present disclosure can include a sunscreen and a mounting bracket assembly. The mounting bracket assembly can include a first bracket and a second bracket. The first bracket can be adapted for securement on an associated building structure and can include a first interengaging feature. The second bracket can be adapted for securement on the sunscreen and can include a second interengaging feature that is cooperative with the first interengaging feature of the first bracket.

Another example of a sunscreen and mounting bracket assembly in accordance with the subject matter of the present disclosure can include a rigid sunscreen and a mounting bracket assembly. The rigid sunscreen can have a length, a width and a height. The rigid sunscreen can include a first end, a second end spaced lengthwise from the first end, a first edge, a second edge spaced widthwise from the first edge, a first wall, and a second wall spaced heightwise from the first wall such that a sunscreen cavity is at least partially defined therebetween. The mounting bracket assembly can include a first bracket secured along the rigid sunscreen and a second bracket that is separate from the first bracket and is adapted for cooperative interengagement with the first bracket as well as for securement on an associated building structure. The first and second brackets can interengage one another such that first and second tabs of the first bracket are at least partially received in respective ones of first and second recesses of the second bracket.

One example of a sunscreen and mounting bracket kit in accordance with the subject matter of the present disclosure can include a rigid sunscreen having a length, a width and a height. The rigid sunscreen can include a first end, a second end spaced lengthwise from the first end, a first edge, a second edge spaced widthwise from the first edge, a first wall, and a second wall spaced heightwise from the first wall such that a sunscreen cavity is at least partially defined therebetween. A mounting bracket assembly can also be included that includes a first bracket dimensioned for securement along the rigid sunscreen and a second bracket that is separate from the first bracket. The second bracket can be adapted for cooperative interengagement with the first bracket and for securement on an associated building structure. For example, the first and second brackets can interengage one another such that first and second tabs of the first bracket are at least partially received in respective ones of first and second recesses of the second bracket.

One example of a method in accordance with the subject matter of the present disclosure of securing a rigid sunscreen on an associated building structure can include providing a rigid sunscreen having a length, a width and a height. The rigid sunscreen can include a first end, a second end spaced lengthwise from the first end, a first edge, a second edge spaced widthwise from the first edge, a first wall, and a second wall spaced heightwise from the first wall such that a sunscreen cavity is at least partially defined therebetween. The method can also include providing a first bracket and securing the first bracket to the rigid sunscreen. The method can further include providing a second bracket and securing the second bracket on a building structure. The method can also include supporting the rigid sunscreen and the first bracket on the second bracket such that the first and second tabs of the first bracket interengage the first and second recesses of the second bracket. The method can further include securing the first bracket and the second bracket together using at least one fastener such that the first and second tabs and the first and second recesses remain interengaged.

One example of a first bracket in accordance with any one of the foregoing paragraphs can include a first mounting wall, a second mounting wall, a first projection wall extending from the first mounting wall, and a second projection wall extending from the second mounting wall. The second mounting wall can extend in approximate alignment with the first mounting wall. The second mounting wall can be spaced from the first mounting wall by a distance greater than the height of the rigid sunscreen such that a bracket cavity dimensioned to receive a portion of the rigid sunscreen is at least partially defined between the first and second mounting walls. The first projection wall can extend from the first mounting wall at a first included angle within a range of approximately 95 degrees to approximately 180 degrees. The second projection wall can extend from the second mounting wall at approximately the first included angle such that the first and second projection walls are disposed in spaced relation to one another. The first projection wall can include a first tab extending therefrom in a first direction. The second projection wall can include a second tab extending therefrom in the first direction. The first and second tabs can extend in the first direction and at a second included angle with respect to at least one of the first and second mounting walls. The second included angle being within a range of approximately 5 degrees to approximately 90 degrees.

One example of a second bracket in accordance with any one of the foregoing paragraphs can include a base wall, a first connecting wall and a second connecting wall. The base wall can include a first surface and an opposing second surface. The first connecting wall can include a first wall portion and a second wall portion. The first wall portion can project outwardly from the base wall from along the second surface and in transverse relation to the base wall. The second wall portion can project from the first wall portion and can extend therefrom in approximate alignment with the base wall. The second wall portion can extend from the first wall portion in a second direction generally opposite the first direction of the first and second tabs of the first bracket and in spaced relation to the base wall such that a first recess is formed between the second wall portion and the base wall. The first recess can be dimensioned to receive a first tab of a first projection wall of a first bracket. The second connecting wall can include a first wall portion and a second wall portion. The first wall portion can project outwardly from the base wall from along the second surface and in transverse relation to the base wall. The second wall portion can project from the first wall portion and can extend therefrom in approximate alignment with the base wall. The second wall portion can extend from the first wall portion in the second direction and in spaced relation to the base wall such that a second recess is formed between the second wall portion and the base wall. The second recess can be dimensioned to receive a second tab of a second projection wall of the first bracket.

DETAILED DESCRIPTION

Figure 1:
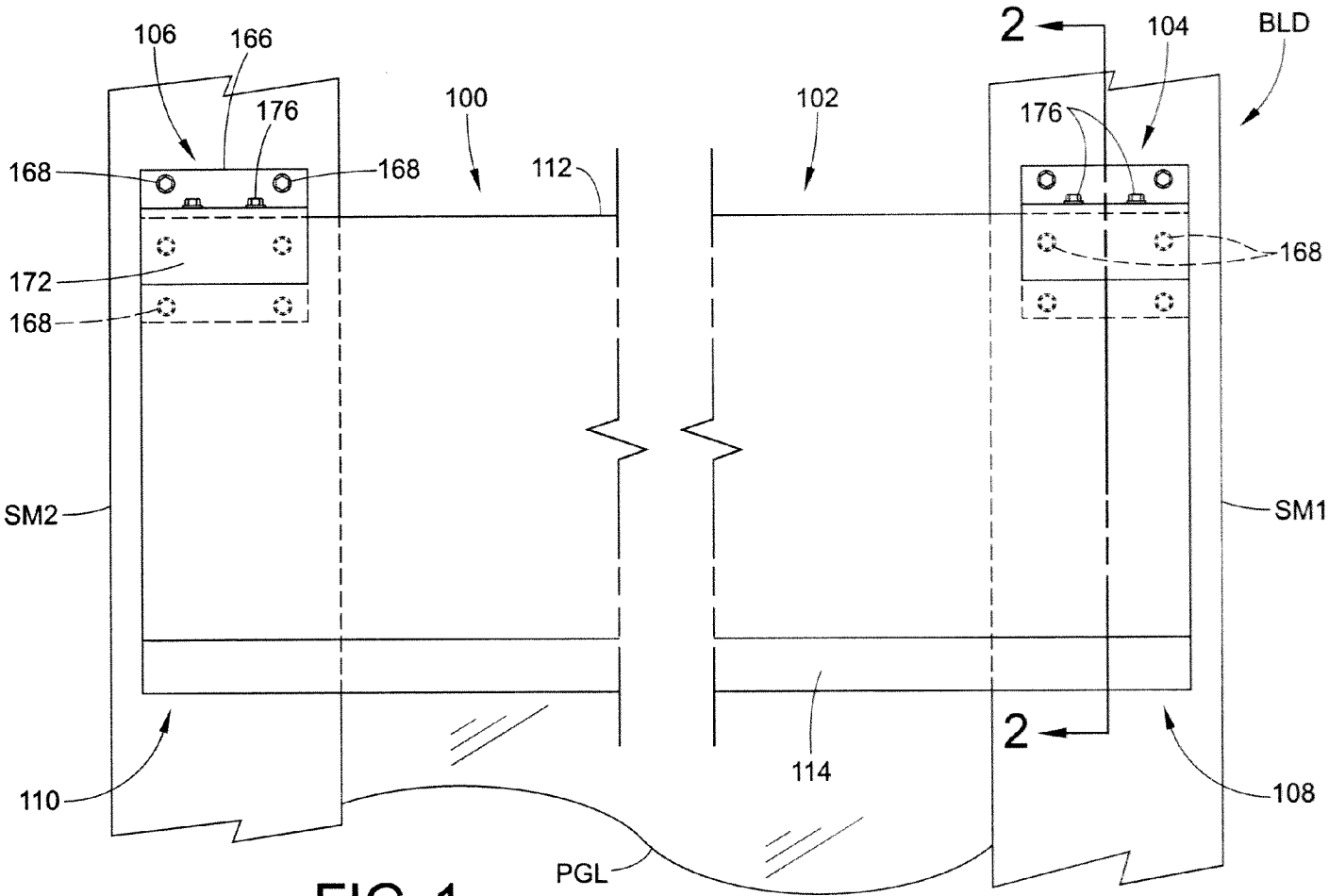
FIG. 1 is a front elevation view of one example of a sunscreen and mounting bracket assembly in accordance with the subject matter of the present disclosure supported on a building structure.
Figure 2:
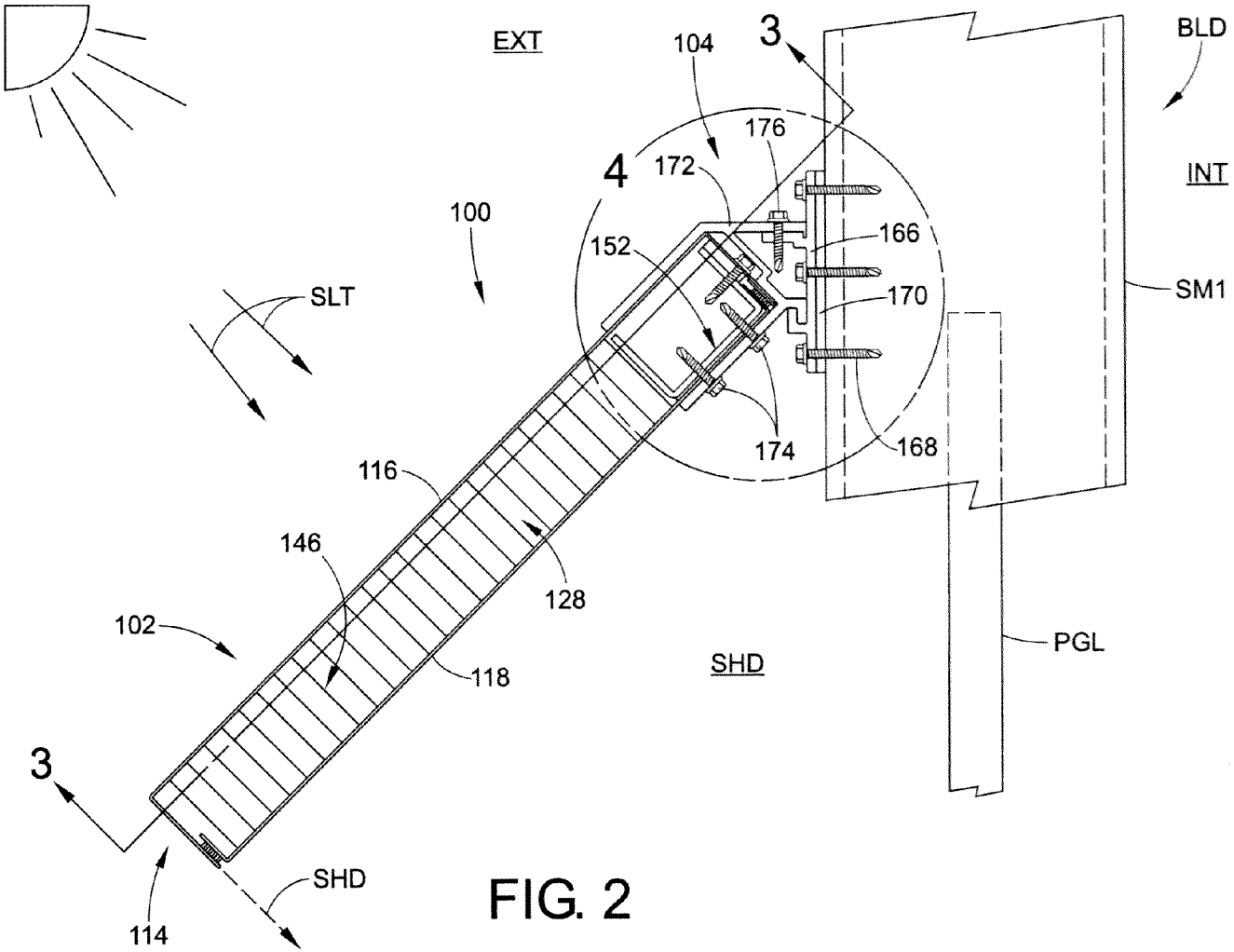
FIG. 2 is a side elevation view in partial cross section of the sunscreen and mounting bracket assembly in FIG. 1 taken from along line 2-2 thereof.

Turning now to the drawings, wherein the showings are for the purpose of illustrating examples of the subject matter of the present disclosure and which are not intended to be limiting, FIGS. 1 and 2 illustrate a sunscreen (which may also be referred to as a sunshade) and mounting bracket assembly in accordance with the subject matter of the present disclosure supported on a portion of a conventional building structure BLD which can be of any suitable type, kind and/or construction. In the example shown in FIGS. 1 and 2, building structure BLD includes a first structural member SM1 and a second structural member SM2. A window is shown as being installed on the building structure between the first and second structural members, and includes a pane of glass PGL that can be supported between the first and second structural members in any suitable manner.

FIGS. 1 and 2 also illustrate a sunscreen and mounting bracket assembly 100 in accordance with the subject matter of the present disclosure that is supported on the building structure, such as by being secured on first and second structural members SM1 and SM2 thereof, for example. Sunscreen and mounting bracket assembly 100 is shown as being supported adjacent the window and positioned such that light and/or other radiation from outside the building, as is represented by reference character EXT, from being transmitted into the interior space of the building structure, which is represented by reference characters INT. As is illustrated in FIG. 2, sunlight and other forms of radiation, which are represented by arrows SLT, stream toward the window of the building structure but is blocked from reaching at least a portion of the pane of glass PGL, as is indicated by the line and area identified by reference character SHD.

One example of a suitable construction for sunscreen and mounting bracket assembly 100 is described in additional detail with reference to FIGS. 3-6. Sunscreen and mounting bracket assembly 100 includes a sunscreen 102 and at least one mounting bracket adapted to secure the sunscreen to a suitable structure or feature of the window or wall of the building structure. In the present exemplary arrangement, first and second mounting bracket assemblies 104 and 106 are shown as being secured on or along first and second structural members SM1 and SM2, respectively. It will be appreciated, however, that any other suitable components and/or features of the building structure could alternately be used.

Figure 3:
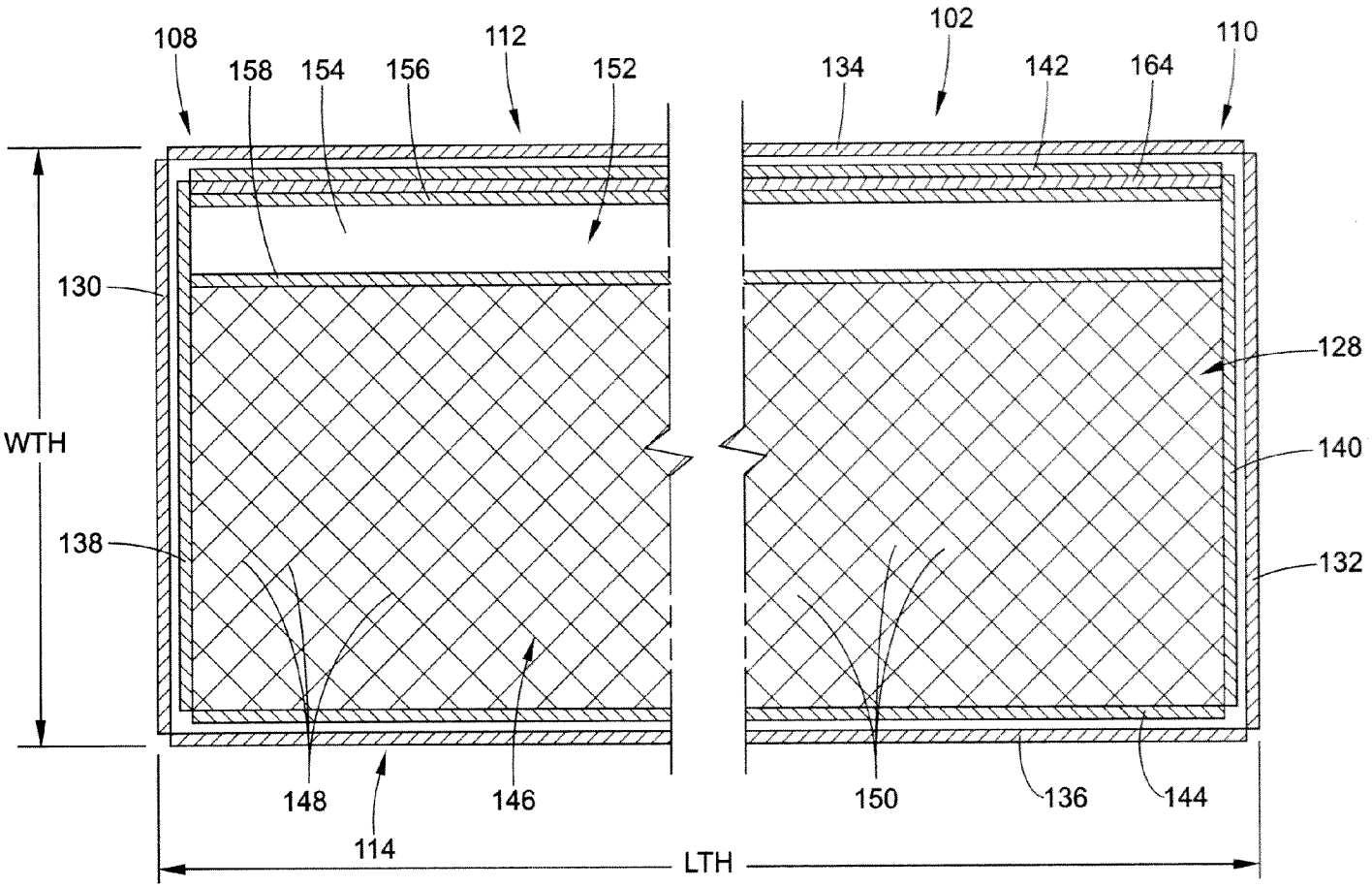
FIG. 3 is a cross-sectional plan view of the sunscreen in FIGS. 1 and 2 taken from along line 3-3 in FIG. 2.

Sunscreen 102 extends longitudinally between a first end 108 and a second end 110 to thereby define a nominal length of the sunscreen, which nominal length is represented in FIG. 3 by reference dimension LTH. Sunscreen 102 also includes first and second longitudinally-extending edges 112 and 114 that are spaced laterally from one another to thereby define a nominal width of the sunscreen, which nominal width is represented in FIG. 3 by reference dimension WTH. It will be appreciated that sunscreen 102 can be of any suitable length and/or width, such as a length within a range of from approximately 3 feet to approximately 15 feet, for example, and a width within a range from approximately 1 foot to approximately 4 feet, for example.

Figure 4:
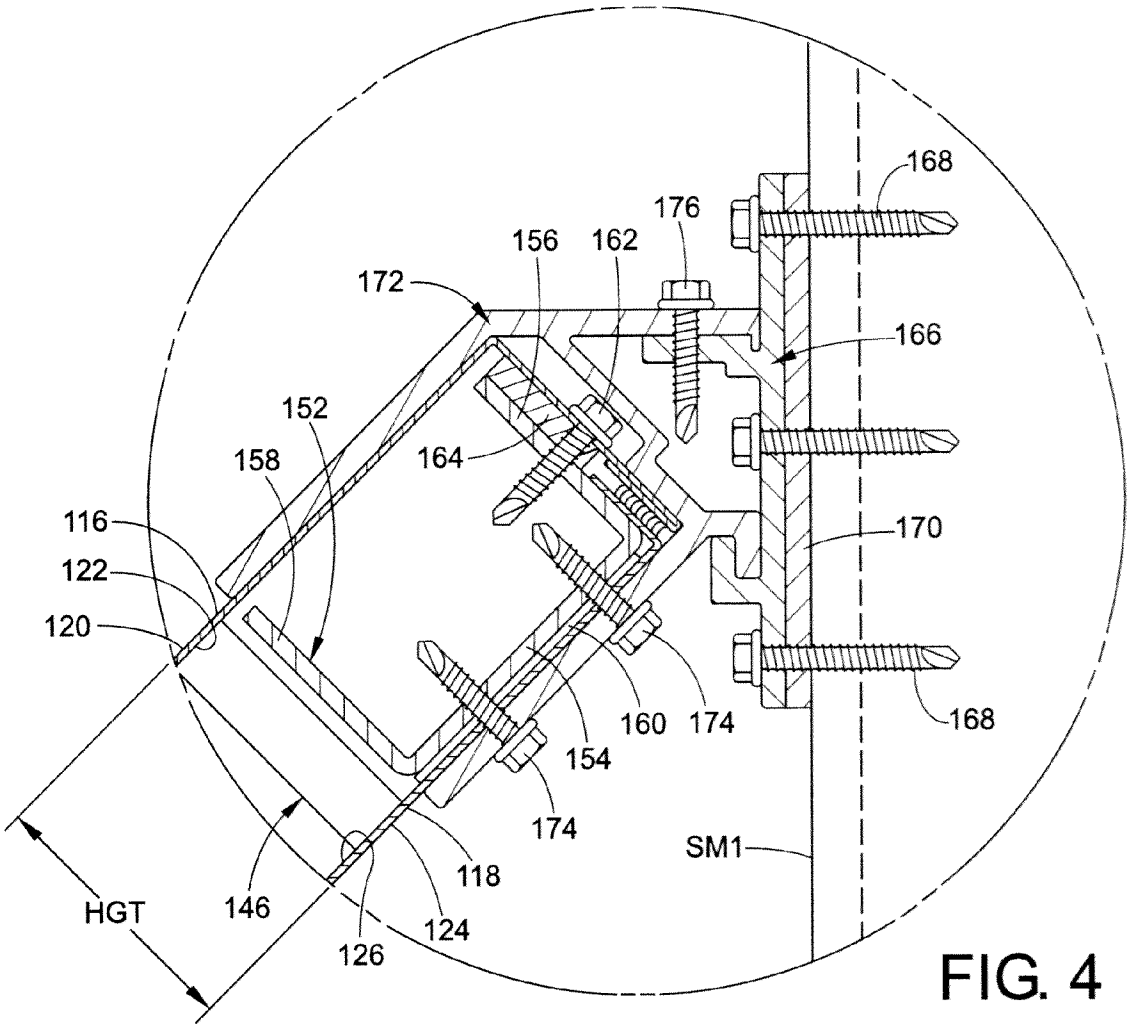
FIG. 4 is an enlarged detail view of the portion of the sunscreen and mounting bracket assembly identified in Detail 4 of FIG. 2.

In the exemplary arrangement shown, sunscreen 102 includes a first or upper wall 116 and a second or lower wall 118 that is spaced from the first wall to thereby define a nominal height of the reflective light shelf, which nominal height is represented in FIG. 4 by reference dimension HGT.

First wall 116 includes an outer surface 120 and an opposing inner surface 122. Similarly, second wall 118 includes an outer surface 124 and an opposing inner surface 126. The first and second walls are oriented relative to one another such that inner surfaces 122 and 126 are facing one another. Additionally, the first and second walls are positioned in spaced relation to one another such that a shelf cavity or space 128 is at least partially defined therebetween.

In the exemplary embodiment shown, first wall 116 also includes optional first and second end wall portions 130 and 132 and optional first and second side wall portions 134 and 136. The end wall portions and/or side wall portions, if provided, can project in a generally heightwise direction from the first wall, such as in a direction away from outer surface 120 and toward inner surface 122, for example. Similarly, second wall 118 can optionally include first and second end wall portions 138 and 140 and/or first and second side wall portions 142 and 144. These end wall portions and/or side wall portions, if provided, can also project in a generally heightwise direction from the second wall, such as in a direction away from outer surface 124 and toward inner surface 126, for example. It will be appreciated that any such end wall portions and/or side wall portions, if included, will act to further define shelf cavity 128 and can also operate as structural features for mounting additional elements and/or components that may be included on or along sunscreen 102.

Sunscreen 102 can also optionally include an inner-core structure disposed within at least a portion of shelf cavity 128. Such an inner-core structure, if provided, can extend in a generally heightwise direction between first wall 116 and second wall 118 and can be in abutting engagement with either or both of the first and second walls. In a preferred arrangement, the inner-core structure is secured on or along at least one of first and second walls 116 and 118 such that a composite beam-like structure is formed thereby. It will be appreciated that the inner-core structure can be of any suitable type, kind, configuration and/or construction. Additionally, it will be appreciated that the inner-core structure can be formed from any suitable material or combination of materials. As one example, the inner-core structure could be at least partially formed from a metal material (e.g., an aluminum alloy honeycomb) that is laminated, adhered, or otherwise attached to at least one of the first and second walls. As another example, the inner-core structure could be at least partially formed from a polymeric material (e.g., a rigid thermoplastic honeycomb or a rigid thermoset foam) that is laminated, adhered or otherwise attached to at least one of the first and second walls. As yet another example, the inner-core structure could be at least partially formed from a composite of fibrous material coated with a polymeric material (e.g., a phenolic resin impregnated paper honeycomb) that is laminated, adhered or otherwise attached to at least one of the first and second walls.

The inner-core structure discussed above is generally represented by item number 146 in the drawings and is shown in FIG. 3 as being of a honeycomb configuration with a plurality of inner-core elements 148 that at least partially define a plurality of cavities or cells 150. It will be appreciated that the inner-core elements and the corresponding cells that are at least partially defined thereby can be of any suitable size, shape, thickness, alignment, configuration and/or arrangement. Additionally, it will be appreciated that such characteristics are expected to vary from application-to-application as well as in relation to the materials and/or construction of the inner-core structure, such as has been discussed above, for example. Furthermore, it will be appreciated that first and second walls 116 and 118 can be formed from any suitable material or combination of materials, such as an aluminum or steel alloy, for example, and that such material choice may also influence the materials, construction and/or other characteristics of the inner-core structure, such as has been discussed above.

Optionally, a sunscreen in accordance with the subject matter of the present disclosure can include one or more support elements received within the sunscreen that act to buttress the sunscreen and/or provide for more robust securement in an installed condition. It will be appreciated that such one or more support elements, if provided, can be of any suitable type, kind, configuration and/or construction. For example, sunscreen 102 is shown in FIGS. 2-4 as including a support element 152 disposed within shelf cavity 128 adjacent side wall portions 134 and/or 142 of the sunscreen. Support element 152 is shown as extending longitudinally along the side wall portions and generally between first and second ends 108 and 110. It will be appreciated that any such one or more support elements, if included, can be of any suitable type, kind, configuration and/or construction. For example, support element 152 is shown in FIGS. 2-4 as taking the form of a C-shaped channel that includes a first wall portion 154 disposed adjacent second wall 118 with second and third wall portions 156 and 158 projecting heightwise from first wall portion 154 toward first wall 116. Support element 152 can be secured on or along any one or more portions of first wall 116 and/or second walls 118 in any suitable manner, such as by using an adhesive substance 160, for example. Additionally, or in the alternative, a threaded fastener 162 could be used, such as in conjunction with an optional spacer element 164, for example, to secure the support element and one or more of the first and second walls together.

Mounting bracket assemblies 104 and 106 can be of any suitable type, kind, configuration and/or construction in accordance with the subject matter of the present disclosure that are suitable for securement of a sunscreen on or along an associated building structure. In the exemplary arrangement shown, mounting bracket assemblies 104 and 106 are substantially similar to one another and include a bracket 166 that is suitable for securement on or along the building structure, such as one of first and second structural members SM1 and SM2, for example. It will be appreciated that the first and second mounting bracket assemblies 104 and 106 can be secured or otherwise attached on or along the associated building structure in any suitable manner, such as by using one or more fasteners 168, for example. Additionally, other mounting hardware and/or components, such as one or more spacers 170, for example, can optionally be included.

Mounting bracket assemblies 104 and 106 are also shown as including a bracket 172 that is adapted for securement on sunscreen 102 to support the same on the associated window, wall or other building structure by cooperatively interengaging bracket 166. Sunscreen 102 and mounting bracket 106 can be operatively connected or otherwise attached to one another in any suitable manner. For example, one or more fasteners 174 can be used that extend through at least a portion of sunscreen 102 and bracket 166 to thereby interconnect the same. In a preferred arrangement, fasteners 174 extend through and threadably interconnect with at least a portion of support element 152 within the sunscreen, such as through first wall portion 154 thereof, for example. Additionally, brackets 166 and 172 are preferably adapted to cooperatively interengage one another and can be further secured to one another in any suitable manner, such as through the use of one or more fasteners 176 that interengage brackets 166 and 172, for example.

Figure 5:
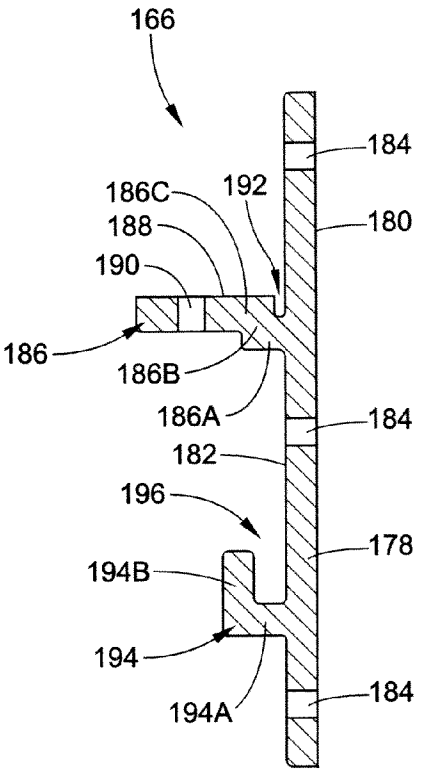
FIG. 5 is a cross-sectional side view of one example of a first portion of the mounting bracket assembly shown in FIGS. 1-4.

As shown in FIG. 5, one example of bracket 166 includes a base wall 178 that has a first surface 180 adapted to abuttingly engage a structural member of the associated building structure or additional mounting hardware or component that might be disposed therebetween, such as spacer 170, for example. Base wall 178 is also shown as having second surface 182 disposed opposite the first surface. A plurality of openings 184, such as holes or elongated slots, for example, extend through base wall 178 and, in a preferred embodiment, are adapted to receive fasteners 168 or other suitable securement devices.

A first or upper connecting wall 186 projects outwardly from second surface 182 of base wall 178. First connecting wall 186 includes a first or upper surface 188 and can also optionally include an opening 190 extending from the upper surface through the connecting wall. Connecting wall 186 includes a wall portion 186A that projects outwardly in a transverse direction from second surface 182 of base wall 178. A wall portion 186B extends from wall portion 186A in approximate alignment with base wall 178. Wall portion 186B is spaced from base wall 178 such that a first recess or slot 192 is at least partially defined on bracket 166, such as in conjunction with second surface 182 of base wall 178, for example. A wall portion 186C can project outwardly from wall portion 186B in a direction transverse to base wall 178. Opening 190 can be disposed along wall portion 186C, as shown in FIGS. 4 and 5.

Bracket 166 also includes a second or lower connecting wall 194 that projects outwardly from second surface 182 of base wall 178. Connecting wall 194 includes a wall portion 194A that projects outwardly in a transverse direction from second surface 182 of base wall 178. A wall portion 194B extends from wall portion 194A in approximate alignment with base wall 178. Additionally, wall portion 194B is spaced from base wall 178 such that a second recess or slot 196 is at least partially defined on bracket 166, such as in conjunction with second surface 182 of base wall 178, for example.

Figure 6:
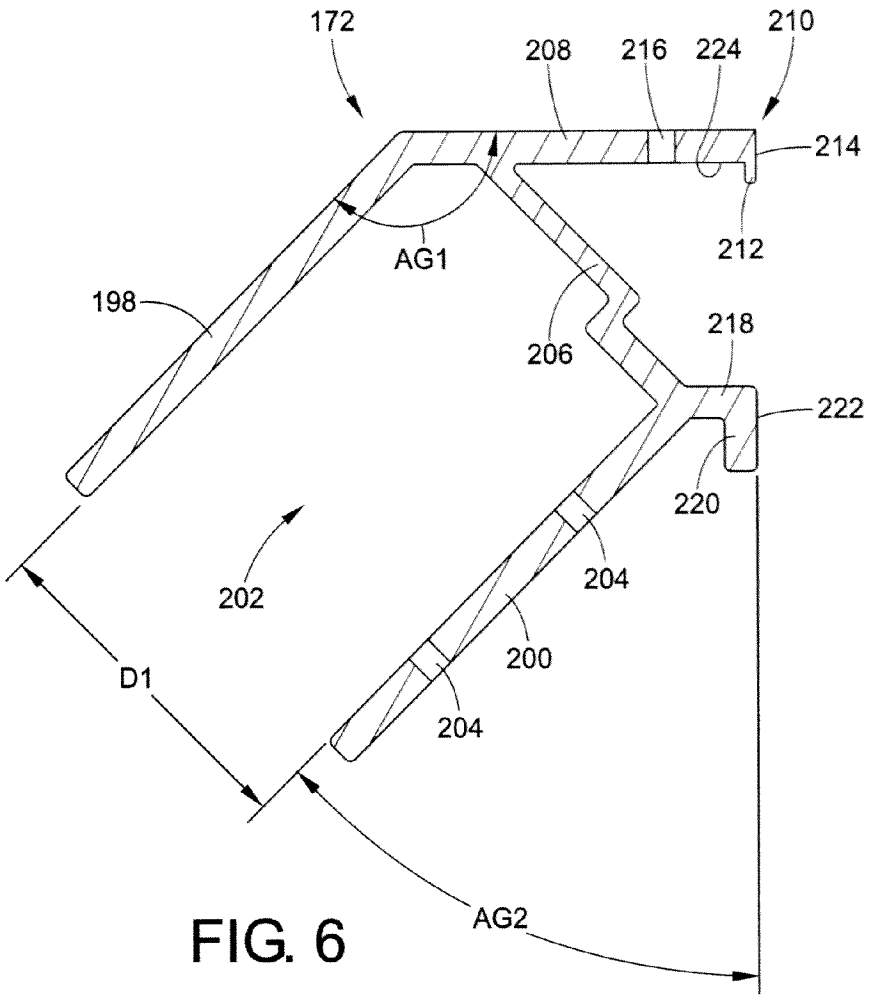
FIG. 6 is a cross-sectional side view of one example of a second portion of the mounting bracket assembly shown in FIGS. 1-4.

As shown in FIG. 6, bracket 172 includes a first mounting wall 198 and a second mounting wall 200 that is spaced from the first mounting wall to at least partially define an envelope or cavity 202 for receiving at least a portion of sunscreen 102. In a preferred arrangement, the first and second mounting walls are spaced apart a distance that is slightly greater than height HGT of sunscreen 102 as is represented in FIG. 6 by reference dimension D1, such that first side 112 of the sunscreen can be received within the envelope that is at least partially defined by first and second mounting walls 198 and 200. Additionally, one or more of the first and second mounting walls can include one or more openings 204, such as a hole or elongated slot, for example, such as may be suitable for receiving fasteners 174, for example.

Bracket 172 is also shown as including an interconnecting wall 206 that extends between first and second mounting walls 198 and 200 to at least approximately maintain the first and second mounting walls in spaced relation to one another. A first or upper projection wall 208 extends from first mounting wall 198 and/or interconnecting wall 206. First projection wall 208 includes a distal end 210 that has a tab or projection 212 extending therefrom in a direction approximately transverse to the first projection wall. Tab 212 includes a distal surface 214 and is adapted to be cooperatively received within slot 192 of bracket 166 such that distal surface 214 is disposed adjacent second surface 182 of bracket 166. First projection wall 208 can also optionally include one or more openings 216 extending therethrough.

Bracket 172 also includes a second or lower projection wall 218 that extends from second mounting wall 200 and/or interconnecting wall 206. Second projection wall 218 also includes a distal end (not numbered) that has a tab or projection 220 extending therefrom in a direction approximately transverse to the second projection wall. Tab 220 includes a distal surface 222 that is shown as being disposed in approximate alignment with distal surface 214. In an alternate arrangement, distal surface 222 may be disposed at an angle to and/or in an offset plane from that of distal surface 214. In either case, tab 220 is preferably adapted to be cooperatively received within slot 196 of bracket 166. Additionally, first projection wall 208 is shown as being disposed at an angle relative to first mounting wall 198, and second projection wall 218 is shown as being disposed at an angle relative to second mounting wall 200. In the exemplary embodiment shown, first and second mounting walls 198 and 200 extend in approximate alignment with one another. Additionally, projection walls 208 and 218 are shown as being disposed in approximate alignment with one another. As such, an included angle is formed between each mounting wall and a corresponding one of the projection walls, such as is represented in FIG. 6 by angular dimension AG1, for example. It will be appreciated that the included angle can be the same or different for each of the two mounting wall and corresponding projection wall combinations. Additionally, it will be appreciated that any suitable value for angle AG1 can be used, such as a value within a range of from approximately 95 degrees to approximately 180 degrees, for example.

In an assembled and installed condition, such as is shown in FIGS. 1, 2 and 4, for example, bracket 166 is secured on or along the building structure such that slots 192 and 196 are outwardly exposed. Bracket 172 is received on sunscreen 102 and secured thereto such that tabs 212 and 220 of the first and second projection walls, respectively, are outwardly exposed. The one or more of brackets 172 that are secured on sunscreen 102 are cooperatively interengaged with a corresponding number of first brackets such that tabs 212 and 220 of at least one bracket 172 are respectively received within slots 192 and 196 of at least one bracket 166. In such condition, a second or bottom surface 224 of first projection wall 208 is disposed in abutting engagement with first surface 188 of first connecting wall 186. Additionally, in a preferred embodiment, opening 216 of first projection wall 208 will be disposed in approximate alignment with opening 190 in first connecting wall 186, such that fasteners 176 can be threadably installed therein, for example. In that the installed orientation of a sunscreen may vary from application to application, the first and second mounting walls are disposed at an angle AG2 relative to tabs 212 and 220. It will be appreciated that any suitable value for angle AG2 can be used, such as a value within a range of from approximately 5 degrees to approximately 90 degrees, for example.

In addition to providing a robust arrangement for securing sunscreens on building structures, the interengagement of tabs 212 and 220 with slots 192 and 196 may permit sunscreen 102 to be temporarily supported in an installed position without the use of fasteners 176. As such, installation can be simplified in that the sunscreen may not need to be separately supported while fasteners 176 are installed. Advantageously, this arrangement may permit a single installer to perform the installation process under some circumstances.

As used herein with reference to certain features, elements, components and/or structures, numerical ordinals (e.g., first, second, third, fourth, etc.) may be used to denote different singles of a plurality or otherwise identify certain features, elements, components and/or structures, and do not imply any order or sequence unless specifically defined by the claim language. Additionally, the terms "transverse," and the like, are to be broadly interpreted. As such, the terms "transverse," and the like, can include a wide range of relative angular orientations that include, but are not limited to, an approximately perpendicular angular orientation.

Furthermore, the phrase "flowed-material joint" and the like are to be interpreted to include any joint or connection in which a liquid or otherwise flowable material (e.g., a melted metal or combination of melted metals) is deposited or otherwise presented between adjacent component parts and operative to form a fixed and substantially fluid-tight connection therebetween. Examples of processes that can be used to form such a flowed-material joint include, without limitation, welding processes, brazing processes and soldering processes. In such cases, one or more metal materials and/or alloys can be used to form such a flowed-material joint, in addition to any material from the component parts themselves. Another example of a process that can be used to form a flowed-material joint includes applying, depositing or otherwise presenting an adhesive between adjacent component parts that is operative to form a fixed and substantially fluid-tight connection therebetween. In such case, it will be appreciated that any suitable adhesive material or combination of materials can be used, such as one-part and/or two-part epoxies, for example.

It will be recognized that numerous different features and/or components are presented in the embodiments shown and described herein, and that no one embodiment is specifically shown and described as including all such features and components. However, it is to be understood that the subject matter of the present disclosure is intended to encompass any and all combinations of the different features and components that are shown and described herein, and, without limitation, that any suitable arrangement of features and components, in any combination, can be used. Thus it is to be distinctly understood claims directed to any such combination of features and/or components, whether or not specifically embodied herein, are intended to find support in the present disclosure.

Thus, while the subject matter of the present disclosure has been described with reference to the foregoing embodiments and considerable emphasis has been placed herein on the structures and structural interrelationships between the component parts of the embodiments disclosed, it will be appreciated that other embodiments can be made and that many changes can be made in the embodiments illustrated and described without departing from the principles hereof. Obviously, modifications and alterations will occur to others upon reading and understanding the preceding detailed description. Accordingly, it is to be distinctly understood that the foregoing descriptive matter is to be interpreted merely as illustrative of the subject matter of the present disclosure and not as a limitation. As such, it is intended that the subject matter of the present disclosure be construed as including all such modifications and alterations insofar as they come within the scope of the appended claims and any equivalents thereof.

The invention claimed is:

1. A rigid sunscreen and mounting bracket assembly adapted for securement on an associated building structure, said sunscreen and mounting bracket assembly comprising:

a rigid sunscreen having a length, a width and a height, said rigid sunscreen including a first end, a second end spaced lengthwise from said first end, a first edge, a second edge spaced widthwise from said first edge, a first wall, and a second wall spaced heightwise from said first wall such that a sunscreen cavity is at least partially defined therebetween; and, a mounting bracket assembly including a first bracket secured along said rigid sunscreen and a second bracket separate from said first bracket, said second bracket adapted for cooperative interengagement with said first bracket and for securement on the associated building structure;

said first bracket including a first mounting wall, a second mounting wall, a first projection wall extending from said first mounting wall, and a second projection wall extending from said second mounting wall, said second mounting wall extending in approximate alignment with said first mounting wall, said second mounting wall being spaced from said first mounting wall by a distance greater than said height of said rigid sunscreen such that a bracket cavity dimensioned to receive a portion of said rigid sunscreen is at least partially defined between said first and second mounting walls, said first projection wall extending from said first mounting wall at a first included angle within a range of approximately 95 degrees to approximately 180 degrees, and said second projection wall extending from said second mounting wall at approximately said first included angle such that said first and second projection walls are disposed in spaced relation to one another, said first projection wall including a first tab extending therefrom in a first direction, said second projection wall including a second tab extending therefrom in said first direction, said first and second tabs extending in said first direction and at a second included angle with respect to at least one of said first and second mounting walls, said second included angle being within a range of approximately 5 degrees to approximately 90 degrees;

said second bracket including a base wall, a first connecting wall and a second connecting wall, said base wall including a first surface and an opposing second surface;

said first connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in a second direction generally opposite said first direction of said first and second tabs of said first bracket and in spaced relation to said base wall such that a first recess is formed between said second wall portion and said base wall, said first recess being dimensioned to receive said first tab of said first projection wall of said first bracket;

said second connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in said second direction and in spaced relation to said base wall such that a second recess is formed between said second wall portion and said base wall, said second recess being dimensioned to receive said second tab of said second projection wall of said first bracket;

said first and second brackets interengaging one another such that said first and second tabs of said first bracket are at least partially received in respective ones of said first and second recesses of said second bracket.

2. The assembly according to claim 1, wherein said first bracket includes an interconnecting wall extending between and operatively interconnect at least one of said first mounting wall and said first projection wall with at least one of said second mounting wall and said second projection wall.

3. The assembly according to claim 1, wherein said first and second tabs each include a distal surface disposed opposite said first and second connecting walls, and said distal surface of said first tab is disposed in a common plane with said distal surface of said second tab.

4. The assembly according to claim 1, wherein said first projection wall of said first bracket includes a first surface, said first connecting wall of said second bracket includes a third wall portion projecting from said second wall portion in transverse relation to said base wall, said third wall portion including a first surface, and said first and second brackets interengaging one another such that said first surface of said first bracket and said first surface of said second bracket form a contact area in which said first surfaces are in abutting engagement with one another.

5. The assembly according to claim 4, wherein said first projection wall of said first bracket includes an opening, said first connecting wall of said second bracket includes an opening formed along said third wall portion, and said openings are disposed in approximate alignment with one another along said contact area between said first surfaces of said first and second brackets.

6. The assembly according to claim 5 further comprising a fastener extending through said opening in said first and second brackets thereby at least partially securing said first and second brackets to one another.

7. The assembly according to claim 1, wherein said first and second walls of said rigid sunscreen each include an inner surface disposed in facing relation to one another, and said rigid sunscreen includes an inner-core structure disposed within said sunscreen cavity between said inner surfaces of said first and second walls.

8. The assembly according to claim 7, wherein said inner-core structure includes one of a metallic honeycomb, a polymeric honeycomb, a polymeric foam and a fibrous honeycomb coated with polymeric material.

9. The assembly according to claim 1, wherein said rigid sunscreen includes a support element extending lengthwise therealong within said sunscreen cavity.

10. The assembly according to claim 9, wherein said support element includes a first wall portion disposed along said second wall of said rigid sunscreen and a second wall projecting in a heightwise direction toward said first wall of said rigid sunscreen.

11. The assembly according to claim 10, wherein said second wall includes an opening extending therethrough, said first wall portion of said support element includes an opening extending therethrough in approximate alignment with said opening in said second wall, and said second mounting wall of said first bracket includes an opening extending therethrough with said first bracket being positioned along said rigid sunscreen such that said opening in said second mounting wall is at least approximately aligned with said openings in said second wall of said rigid sunscreen and said first wall portion of said support element.

12. The assembly according to claim 11 further comprising a fastener extending through said openings in said second mounting wall of said first bracket, said second wall of said rigid sunscreen and said first wall portion of said support element.

13. A mounting bracket assembly dimensioned for securement along an associated rigid sunscreen and adapted to secure the associated rigid sunscreen to an associated building structure, said mounting bracket assembly comprising:

a first bracket dimensioned for securement along the associated rigid sunscreen and a second bracket separate from said first bracket, said second bracket adapted for cooperative interengagement with said first bracket and for securement on the associated building structure;

said first bracket including a first mounting wall, a second mounting wall, a first projection wall extending from said first mounting wall, and a second projection wall extending from said second mounting wall, said second mounting wall extending in approximate alignment with said first mounting wall, said second mounting wall being spaced from said first mounting wall such that a bracket cavity dimensioned to receive the associated rigid sunscreen is at least partially defined between said first and second mounting walls, said first projection wall extending from said first mounting wall at a first included angle within a range of approximately 95 degrees to approximately 180 degrees, and said second projection wall extending from said second mounting wall at approximately said first included angle such that said first and second projection walls are disposed in spaced relation to one another, said first projection wall including a first tab extending therefrom in a first direction, said second projection wall including a second tab extending therefrom in said first direction, said first and second tabs extending in said first direction and at a second included angle with respect to at least one of said first and second mounting walls, said second included angle being within a range of approximately 5 degrees to approximately 90 degrees;

said second bracket including a base wall, a first connecting wall and a second connecting wall, said base wall including a first surface and an opposing second surface;

said first connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in a second direction generally opposite said first direction of said first and second tabs of said first bracket and in spaced relation to said base wall such that a first recess is formed between said second wall portion and said base wall, said first recess being dimensioned to receive said first tab of said first projection wall of said first bracket;

said second connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in said second direction and in spaced relation to said base wall such that a second recess is formed between said second wall portion and said base wall, said second recess being dimensioned to receive said second tab of said second projection wall of said first bracket;

said first and second brackets interengaging one another such that said first and second tabs of said first bracket are at least partially received in respective ones of said first and second recesses of said second bracket.

14. The mounting bracket assembly according to claim 13, wherein said first bracket includes an interconnecting wall extending between and operatively interconnect at least one of said first mounting wall and said first projection wall with at least one of said second mounting wall and said second projection wall.

15. The mounting bracket assembly according to claim 13, wherein said first and second tabs each include a distal surface disposed opposite said first and second connecting walls, and said distal surface of said first tab is disposed in a common plane with said distal surface of said second tab.

16. The mounting bracket assembly according to claim 13, wherein said first projection wall of said first bracket includes a first surface, said first connecting wall of said second bracket includes a third wall portion projecting from said second wall portion in transverse relation to said base wall, said third wall portion including a first surface, and said first and second brackets interengage one another such that said first surface of said first bracket and said first surface of said second bracket form a contact area in which said first surfaces are in abutting engagement with one another.

17. The mounting bracket assembly according to claim 16, wherein said first projection wall of said first bracket includes an opening, said first connecting wall of said second bracket includes an opening formed along said third wall portion, and said openings are disposed in approximate alignment with one another along said contact area between said first surfaces of said first and second brackets.

18. The mounting bracket assembly according to claim 17 further comprising a fastener extending through said opening in said first and second brackets thereby at least partially securing said first and second brackets to one another.

19. A rigid sunscreen and mounting bracket kit comprising:

a rigid sunscreen having a length, a width and a height, said rigid sunscreen including a first end, a second end spaced lengthwise from said first end, a first edge, a second edge spaced widthwise from said first edge, a first wall, and a second wall spaced heightwise from said first wall such that a sunscreen cavity is at least partially defined therebetween; and, a mounting bracket assembly including a first bracket dimensioned for securement along said rigid sunscreen and a second bracket separate from said first bracket, said second bracket adapted for cooperative interengagement with said first bracket and for securement on an associated building structure;

said first bracket including a first mounting wall, a second mounting wall, a first projection wall extending from said first mounting wall, and a second projection wall extending from said second mounting wall, said second mounting wall extending in approximate alignment with said first mounting wall, said second mounting wall being spaced from said first mounting wall by a distance greater than said height of said rigid sunscreen such that a bracket cavity dimensioned to receive a portion of said rigid sunscreen is at least partially defined between said first and second mounting walls, said first projection wall extending from said first mounting wall at a first included angle within a range of approximately 95 degrees to approximately 180 degrees, and said second projection wall extending from said second mounting wall at approximately said first included angle such that said first and second projection walls are disposed in spaced relation to one another, said first projection wall including a first tab extending therefrom in a first direction, said second projection wall including a second tab extending therefrom in said first direction, said first and second tabs extending in said first direction and at a second included angle with respect to at least one of said first and second mounting walls, said second included angle being within a range of approximately 5 degrees to approximately 90 degrees;

said second bracket including a base wall, a first connecting wall and a second connecting wall, said base wall including a first surface and an opposing second surface;

said first connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in a second direction generally opposite said first direction of said first and second tabs of said first bracket and in spaced relation to said base wall such that a first recess is formed between said second wall portion and said base wall, said first recess being dimensioned to receive said first tab of said first projection wall of said first bracket;

said second connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in said second direction and in spaced relation to said base wall such that a second recess is formed between said second wall portion and said base wall, said second recess being dimensioned to receive said second tab of said second projection wall of said first bracket.

20. A method of securing a rigid sunscreen on an associated building structure, said method comprising:

providing a rigid sunscreen having a length, a width and a height, said rigid sunscreen including a first end, a second end spaced lengthwise from said first end, a first edge, a second edge spaced widthwise from said first edge, a first wall, and a second wall spaced heightwise from said first wall such that a sunscreen cavity is at least partially defined therebetween;

providing a first bracket and securing said first bracket to said rigid sunscreen, said first bracket including a first mounting wall, a second mounting wall, a first projection wall extending from said first mounting wall, and a second projection wall extending from said second mounting wall, said second mounting wall extending in approximate alignment with said first mounting wall, said second mounting wall being spaced from said first mounting wall such that a bracket cavity dimensioned to receive the associated rigid sunscreen is at least partially defined between said first and second mounting walls, said first projection wall extending from said first mounting wall at a first included angle within a range of approximately 95 degrees to approximately 180 degrees, and said second projection wall extending from said second mounting wall at approximately said first included angle such that said first and second projection walls are disposed in spaced relation to one another, said first projection wall including a first tab extending therefrom in a first direction, said second projection wall including a second tab extending therefrom in said first direction, said first and second tabs extending in said first direction and at a second included angle with respect to at least one of said first and second mounting walls, said second included angle being within a range of approximately 5 degrees to approximately 90 degrees;

providing a second bracket and securing said second bracket on a building structure, said second bracket including a base wall, a first connecting wall and a second connecting wall, said base wall including a first surface and an opposing second surface, said first connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in a second direction generally opposite said first direction of said first and second tabs of said first bracket and in spaced relation to said base wall such that a first recess is formed between said second wall portion and said base wall, said first recess being dimensioned to receive said first tab of said first projection wall of said first bracket, said second connecting wall including a first wall portion and a second wall portion, said first wall portion projecting outwardly from said base wall from along said second surface and in transverse relation to said base wall, said second wall portion projecting from said first wall portion and extending therefrom in approximate alignment with said base wall, said second wall portion extending from said first wall portion in said second direction and in spaced relation to said base wall such that a second recess is formed between said second wall portion and said base wall, said second recess being dimensioned to receive said second tab of said second projection wall of said first bracket;

supporting said rigid sunscreen and said first bracket on said second bracket such that said first and second tabs of said first bracket interengage said first and second recesses of said second bracket; and, securing said first bracket and said second bracket together using at least one fastener such that said first and second tabs and said first and second recesses remain interengaged.

21. The method according to claim 20, wherein said action of providing a first bracket includes providing a first surface on said first projection wall of said first bracket, said action of providing a second bracket includes providing a third wall portion projecting from said second wall portion of said first connecting wall in transverse relation to said base wall, said third wall portion including a first surface, and said action of supporting said rigid sunscreen and said first bracket on said second bracket includes forming a contact area with said first surface of said first bracket and said first surface of said second bracket in which said first surfaces are in abutting engagement with one another.

22. The method according to claim 21, wherein said action of providing a first surface on said first projection wall includes providing an opening extending through said first projection wall along said first surface, said action of providing a third wall portion along said first connecting wall of said second bracket includes providing an opening formed along said third wall portion, and said action of supporting said rigid sunscreen and said first bracket on said second bracket includes at least approximately aligning said openings with one another along said contact area between said first surfaces of said first and second brackets.

23. The method according to claim 22 further comprising installing a fastener through said opening in said first and second brackets to thereby at least partially secure said first and second brackets to one another.

* * * * *